United States Patent [19]

Roberts

[11] 4,402,674

[45] Sep. 6, 1983

[54] AIR ASPIRATION PREVENTION PAN

[75] Inventor: David Roberts, North Vancouver, Canada

[73] Assignees: Versatech Products Inc., North Vancouver, Canada; Versatech Products Inc., North Vancouver, Canada

[21] Appl. No.: 353,823

[22] Filed: Mar. 2, 1982

[51] Int. Cl.[3] ..... B63H 11/00

[52] U.S. Cl. ..... 440/38; 440/46

[58] Field of Search ..... 440/38, 40, 41, 42, 440/43, 46, 47

[56] References Cited

U.S. PATENT DOCUMENTS 3,253,567 5/1966 Patton, Jr. ..... 440/46

3,840,319 10/1974 Rhoda ..... 440/38

*Primary Examiner*—Trygve M. Blix

*Assistant Examiner*—Rodney Corl

*Attorney, Agent, or Firm*—Carver & Co.

[57] ABSTRACT

An air aspiration prevention pan adapted to prevent aerated water from entering the intake of a water jet propulsion unit mounted in the hull of a water craft having low or zero dead rise characteristics or in a hull having sponsons or spaced apart skegs. The air aspiration prevention pan comprises sidewalls extending downwardly from the mounting means in a general V-configuration with the apex of the "V" toward the forward end of the hull. A lip extends outwardly from the bottom of the sidewalls and acts with them to confine and guide the aerated water under the hull so as to prevent a substantial portion of the aerated water from entering the intake of the water jet propulsion unit.

18 Claims, 5 Drawing Figures

AIR ASPIRATION PREVENTION PAN

FIELD OF THE INVENTION

This invention relates to a water jet propelled water craft and, more particularly, to an air aspiration prevention pan which is used on hulls of low or zero dead rise or on hulls having sponsons or spaced apart skegs.

BACKGROUND OF THE INVENTION

Water jets are commonly used to propel various types of water craft. There are inherent advantages in using water jet propulsion, an important one being that the required water operating depth of a water jet propelled craft can be minimized. This allows the craft to operate in relatively shallow waters or closely to the shore which may be important depending on the uses to which the craft may be put.

Water jets, however, have disadvantages on certain type of vessels. One disadvantage of using water jet propulsion is that air may become entrapped beneath the boat hull and later enters the intake of the water jet. Air entering the water jet propulsion unit results in a loss of thrust and efficiency and tends to overspeed the engine.

This problem is not acute in V-shaped hulls where the presence of aerated water at the apex of the "V" is minimal because of the hull shape. As the inclination of the "V" decreases, however, it becomes more of a problem until when a boat with a flat bottom, sponsons or spaced apart skegs is used, the problem becomes of considerable concern.

SUMMARY OF THE INVENTION

According to the invention, there is disclosed an air aspiration prevention pan adapted for use on the hull of a water jet powered water craft, said pan comprising mounting means adapted to mount on the underside and rearwardly of said hull, sidewalls extending downwardly from said mounting means, a lower lip on the bottom of said sidewalls and extending outwardly therefrom, a bottom plate joining the bottom of said sidewalls and extending therebetween and an intake opening in said bottom plate, said sidewalls and said lower lip acting to confine aerated water under said boat hull when under operating conditions and to substantially prevent said aerated water from entering said intake opening.

According to a further aspect of the invention, there is disclosed a water craft having a hull of low or zero dead rise configuration, said water craft comprising a power source, a water jet propulsion unit operated by said power source, a water intake for said water jet propulsion unit, a water efflux assembly for said water jet propulsion unit and an air aspiration prevention pan mounted on the bottom of said hull and rearwardly therein, said air aspiration pan comprising mounting means adapted to mount in said hull, sidewalls extending downwardly from said mounting means, a lower lip on the bottom of said sidewalls and extending outwardly therefrom, and a bottom plate joining the bottom of said sidewalls and extending therebetween, said water intake being located in said bottom plate, said sidewalls and said lower lip acting to confine aerated water under said hull when under operating conditions and to substantially prevent said aerated water from entering said intake.

DESCRIPTION OF THE DRAWINGS

In drawings, which illustrate an embodiment of the invention.

DESCRIPTION OF SPECIFIC EMBODIMENT

Figure 1:
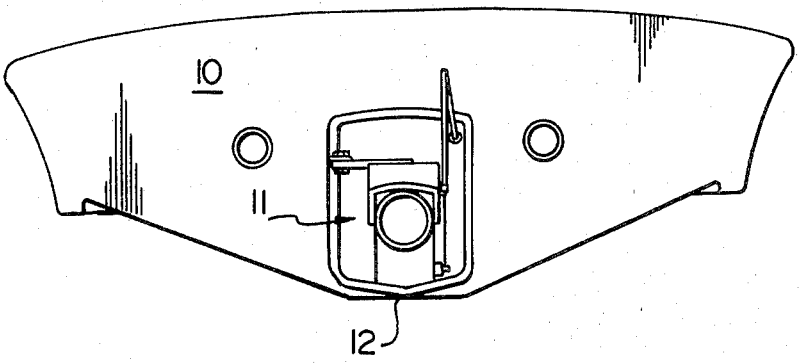
FIG. 1 depicts a V-shaped boat hull with a water jet propulsion unit mounted therein.

Referring now to the drawings, a conventional V-shaped boat hull 10 with a water jet propulsion unit 11 installed therein is shown in FIG. 1. As can be seen from this hull design, little or no air become entrapped under this hull because of the V-shape. The intake 12 for the water jet propulsion unit 11 is located on the bottom of the hull and the air entering this intake is of a magnitude that does not present a significant loss of power.

Figure 2:
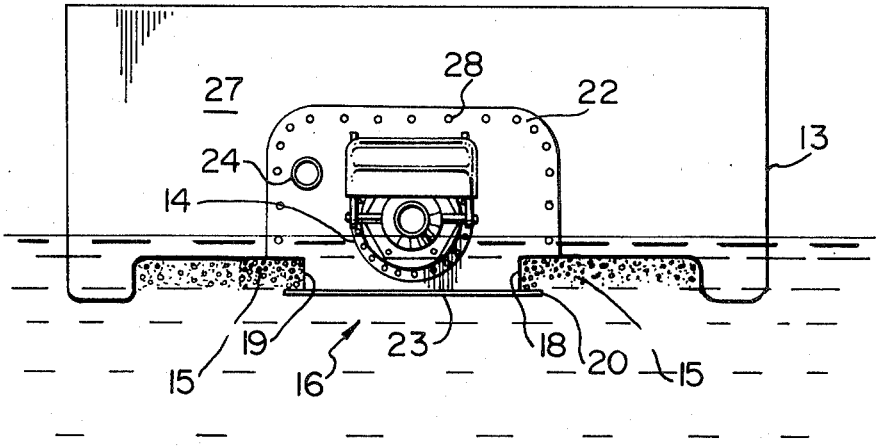
FIG. 2 is a cross-sectional view of the boat hull used with the present invention.

The boat hull 13, however, as illustrated in FIG. 2, is used on utility vessels, particularly those vessels known as SEALANDER TM work boats. These work boats create very little draft and are, therefore, ideal for work in shallow water conditions or near the shore. The use of a water jet propulsion unit 14 enhances this capability.

When water craft with hulls similar to that shown in FIG. 2 are operated, however, air bubbles or aerated water 15 caused by turbulence, debris, waves, etc., become entrained under the hull 13 and enter the intake 12 of the water jet propulsion unit 14. This aerated water 15 can cause a loss of thrust and efficiency in the water jet propulsion unit 14 and, as well, can cause the engine to overspeed. It is, therefore, desirable to reduce this problem as far as possible.

Figure 4A:
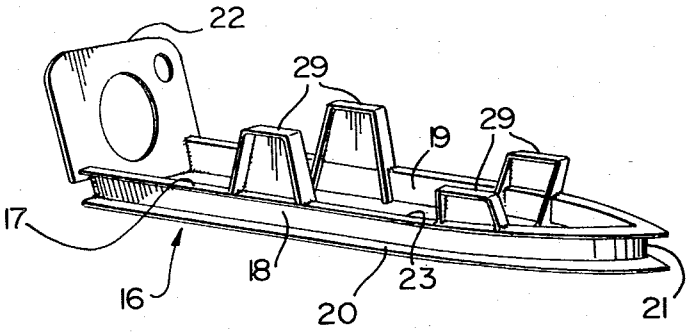
FIG. 4A depicts the air aspiration prevention pan of the present invention before installation.

The air aspiration prevention pan of the present invention is generally shown at 16. It comprises a mounting flange 17 (FIG. 4A), downwardly extending sidewalls 18, 19 and a lower lip 20 which extends outwardly from the bottom of the sidewalls 18, 19. Sidewalls 18, 19 are spaced apart at the rearward end of the air aspiration prevention pan 16, move forwardly generally parallel and then close together to join in an intersection at the nose or forward end 21.

Figure 4B:
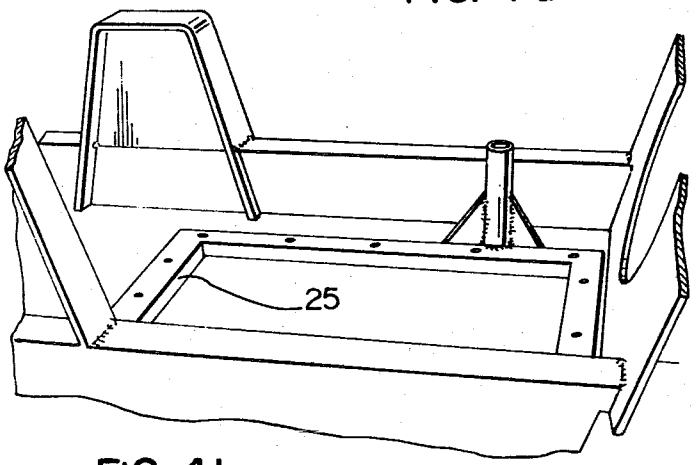
FIG. 4B depicts the intake opening in the air aspiration prevention pan.

A rearward transom plate 22 joins the sidewalls 18, 19 at the rearward end and is adapted to allow the mounting of the water jet propulsion unit 14 and the engine exhaust 24 (FIG. 2). A bottom plate 23 joins the sidewalls 18, 19 and has an intake opening 25 located therein (FIG. 4B).

The sidewalls 18, 19 are designed to extend downwardly from the mounting flange 17 a distance sufficient to extend below the lower boundary of the aerated water 15. The lower lip 20, on the other hand, is designed to extend outwardly a distance from the sidewalls 18, 19 sufficient to keep a substantial portion of the aerated water 15 away from the intake opening 25.

Figure 3:
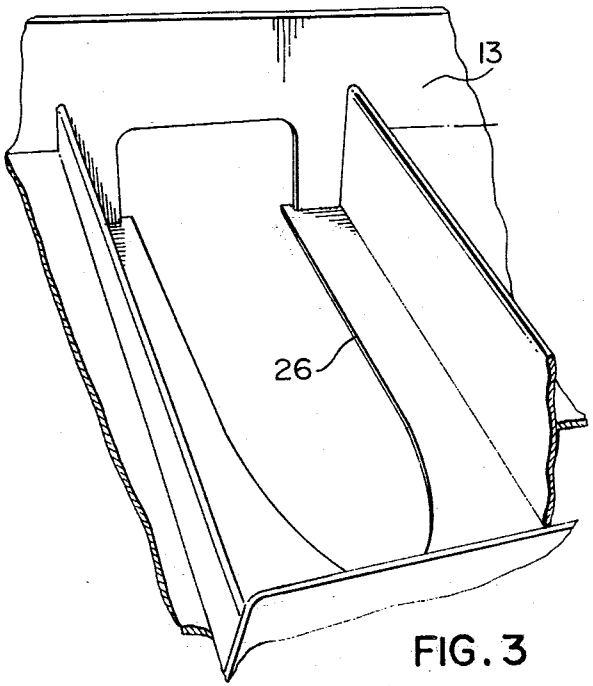
FIG. 3 depicts the jet pan cutout in the boat hull.

The air aspiration prevention pan 16 is designed to be inserted into a recess or cutout 26 formed in the hull 13 (FIG. 3). The air aspiration prevention pan 16 is simply inserted into the cutout 26 with the mounting flange 17 resting on the inside of the hull 13. The mounting flange 17 and the transom plate 22 are then bolted to the hull 13 and the transom 27, respectively, with fasteners 28.

After the assembly 16 is mounted to the hull 13, the engine (not shown) is mounted to the engine mounts 29 and the water jet propulsion unit 14 is mounted to the transom plate 22 and the flange of the intake opening 25.

OPERATION

Under operation, air which is created by turbulence, mixing, wave action, debris, etc. is entrained and passes under the hull 13 until it reaches the forward end or nose 21 of the air aspiration prevention pan assembly 16. A major portion of the aerated water 15 does not extend below the lower lip 20 and it therefore passes along the sidewalls 18, 19 as they separate from the nose 21. To prevent any "spill over" of the aerated water 15, lower lip 20 provides a channel through which the aerated water may run thereby preventing it from entering the intake opening 25.

All of the dimensions of the air aspiration prevention pan may be changed depending on the hull configuration and the operating conditions and characteristics of the water craft. The air aspiration prevention pan need not be an assembly but rather may be mounted as individual pieces as the particular craft may require.

Other modifications may be made to the apparatus without departing from the inventive concepts described herein. The description given, therefore, is only by way of example and not a limitation to the scope of the accompanying claims.

I claim:

1. An air aspiration prevention pan adapted for use on the hull of a water jet powered water craft, said pan comprising mounting means adapted to mount on the underside and rearwardly of said hull, sidewalls extending downwardly from said mounting means, a lower lip on the bottom of said sidewalls extending outwardly therefrom, a bottom plate joining the bottom of said sidewalls and extending therebetween and an intake opening in said bottom plate, said sidewalls and said lower lip acting to confine aerated water under said boat hull when under operating conditions and to substantially prevent said aerated water from entering said intake opening.

2. An air aspiration prevention pan as in claim 1 wherein said sidewalls are spaced apart rearwardly, extend forwardly in a general "V" configuration and join together at a nose portion.

3. An air aspiration prevention pan as in claim 2 wherein said sidewalls extend downwardly a distance greater than the expected depth of substantially all of the aerated water under said hull when said water craft is under operating conditions.

4. An air aspiration prevention pan as in claim 3 wherein said lower lip extends outwardly from said sidewalls a distance sufficient to substantially prevent said aerated water from gaining access to said intake opening when said water craft is under operating conditions.

5. An air aspiration pan as in claim 4 and further comprising a transom plate joining the rear opening of the spaced apart sidewalls and extending generally upwardly, said rearwardly mounted plate being adapted to allow the mounting of a water jet nozzle therein.

6. An air aspiration prevention pan as in claim 5 wherein said mounting means, said sidewalls, said lower lip, said bottom plate and said transom plate all comprise a single assembly.

7. An air aspiration prevention pan as in claim 6 and further comprising means to allow the installation of an engine on said assembly.

8. An air aspiration prevention pan adapted for use on the hull of a water jet powered water craft, said pan comprising mounting means adapted to mount on the underside and rearwardly of said hull, sidewalls extending downwardly from said mounting means a distance greater than the expected depth of substantially all of the aerated water under said hull when said hull is under operating conditions, said sidewalls being spaced apart rearwardly and extending forwardly in a general "V" configuration to join at a nose portion, a bottom plate joining and extending between the bottom of said sidewalls with an intake opening located therein, and a lower lip extending outwardly from the bottom of said sidewalls a distance sufficient to prevent substantially all of said aerated water from entering said intake opening when said hull is under operating conditions.

9. A water craft having a hull of low or zero dead rise configuration, said water craft comprising a power source, a water jet propulsion unit operated by said power source, a water intake for said water jet propulsion unit, a water efflux assembly for said water jet propulsion unit and an air aspiration prevention pan mounted on the bottom of said hull and rearwardly therein, said air aspiration pan comprising mounting means adapted to mount in said hull, sidewalls extending downwardly from said mounting means, a lower lip on the bottom of said sidewalls and extending outwardly therefrom, and a bottom plate joining the bottom of said sidewalls and extending therebetween, said water intake being located in said bottom plate, said sidewalls and said lower lip acting to confine aerated water under said hull when under operating conditions and to substantially prevent said aerated water from entering said intake.

10. A water craft as in claim 9 wherein said sidewalls of said air aspiration prevention pan are spaced apart rearwardly, extend forwardly in a general "V" configuration and join together at a nose portion.

11. A water craft as in claim 10 wherein said sidewalls of said air aspiration prevention pan extend downwardly a distance greater than the expected depth of substantially all of said entrapped air under said hull when said water craft is under operating conditions.

12. A water craft as in claim 11 wherein said lower lip of said air aspiration prevention pan extends outwardly from said sidewalls a distance sufficient to substantially prevent entrapped air from gaining access to said water intake when said water craft is under operating conditions.

13. A water craft as in claim 12 wherein said air aspiration prevention pan further comprises a transom plate joining the rear opening of the spaced apart sidewalls and extending generally upwardly, said rearwardly mounted transom plate being adapted to allow the mounting of said water efflux assembly.

14. A water craft as in claim 13 wherein said air aspiration prevention pan comprises a single assembly adapted to be removed from said water craft without disassembly.

15. A water craft as in claim 14 wherein said air aspiration prevention pan also comprises means to allow the installation of said power source.

16. A water craft having a hull of low or zero dead rise configuration, said water craft comprising a power source, a water jet propulsion unit adapted to operate by said power source, a water intake and a water efflux assembly for said water propulsion unit, and an air aspiration prevention pan mounted on the bottom and rearwardly in said hull, said air aspiration prevention pan comprising mounting means mounted in said hull, sidewalls protruding downwardly from said hull and extending from a spaced apart rearward position forwardly in a general "V" configuration to a position where said sidewalls contact at a nose position, a lip extending outwardly from the bottom of said sidewalls and a bottom plate adapted to allow mounting of said water intake assembly and joining and extending between the bottom of said sidewalls, said sidewalls protruding downwardly and said lip extending outwardly a distance sufficient to contain and confine a substantial portion of aerated water and to keep said substantial portion of said aerated water from entering said water intake when said water craft is under operation conditions.

17. A water craft as in claim 16 wherein said air aspiration prevention pan further comprises a transom plate extending generally upwardly from the rearward portion of said bottom plate, said transom plate adapted to allow the mounting of said water jet efflux assembly therein.

18. A water craft as in claim 17 said air aspiration prevention pan may be removed and installed in said water craft as a single assembly.

* * * * *